US008308006B2

(12) United States Patent
Nievierowski et al.

(10) Patent No.: US 8,308,006 B2
(45) Date of Patent: Nov. 13, 2012

(54) THIN WALLED HOT FILLED CONTAINER

(75) Inventors: John A. Nievierowski, Ann Arbor, MI (US); Patricia M. Maslak, Plymouth, MI (US); Walter J. Strasser, Cement City, MI (US); Luke A. Mast, Brooklyn, MI (US); Frederick C. Beuerle, Jackson, MI (US)

(73) Assignee: Amcor Limited, Hawthorn (AU)

( * ) Notice: Subject to any disclaimer, the term of this patent is extended or adjusted under 35 U.S.C. 154(b) by 567 days.

(21) Appl. No.: 12/499,880

(22) Filed: Jul. 9, 2009

(65) Prior Publication Data

US 2010/0006533 A1 Jan. 14, 2010

Related U.S. Application Data

(60) Provisional application No. 61/079,325, filed on Jul. 9, 2008.

(51) Int. Cl.
*B65D 90/02* (2006.01)

(52) U.S. Cl. ..... 215/381; 215/379; 215/382; 220/666; 220/675

(58) Field of Classification Search ..... 215/379, 215/381, 382; 220/666, 675
See application file for complete search history.

(56) References Cited

U.S. PATENT DOCUMENTS

| | | | |
|---|---|---|---|
| 4,610,366 | A | 9/1986 | Estes et al. |
| 5,005,716 | A | 4/1991 | Eberle |
| 5,060,453 | A | 10/1991 | Alberghini et al. |
| 5,092,475 | A | 3/1992 | Krishnakumar et al. |
| 5,141,121 | A | 8/1992 | Brown et al. |
| 5,178,289 | A | 1/1993 | Krishnakumar et al. |
| 5,222,615 | A | 6/1993 | Ota et al. |
| 5,303,834 | A | 4/1994 | Krishnakumar et al. |
| 5,341,946 | A | 8/1994 | Vailliencourt et al. |

(Continued)

FOREIGN PATENT DOCUMENTS

| | | |
|---|---|---|
| EP | 1 947 016 | 7/2008 |

OTHER PUBLICATIONS

Supplementary European Search Report dated May 23, 2011 in corresponding European patent application No. EP 09 79 5182.

*Primary Examiner* — Anthony Stashick
*Assistant Examiner* — Elizabeth Volz
(74) *Attorney, Agent, or Firm* — Harness, Dickey & Pierce, P.L.C.

(57) ABSTRACT

A hot-fill container may have a shoulder portion, body portion, bottom portion, and numerous strengthening grooves and a thin-walled, flexible, bag-like, collapsible portion in the body portion. The collapsible portion may be located between the strengthening ribs. The container structure may also employ one or more vacuum panels in the body portion that may lie between the collapsible portion and the bottom portion. The vacuum panels and the collapsible body portion may move toward a central vertical axis when the container is subjected to an internal vacuum pressure. Strengthening grooves may border the collapsible body portion, which may be circular in pre-vacuum cross-section but polygonal in post-vacuum cross-section. Part of the collapsible portion may be concave inward toward a central vertical axis of the container while part of the collapsible portion may move away from the central vertical axis. Vertical columns may support the collapsible portion.

15 Claims, 13 Drawing Sheets

U.S. PATENT DOCUMENTS 5,392,937 A 2/1995 Prevot et al.
5,407,086 A 4/1995 Ota et al.
5,598,941 A 2/1997 Semersky et al.
D380,685 S 7/1997 Steih
5,704,503 A * 1/1998 Krishnakumar et al. ..... 215/381
5,758,790 A 6/1998 Ewing, Jr.
5,762,221 A 6/1998 Tobias et al.
6,016,932 A 1/2000 Gaydosh et al.
6,044,996 A 4/2000 Carew et al.
6,520,362 B2 2/2003 Heisel et al.
6,554,146 B1 4/2003 DeGroff et al.
6,585,125 B1 7/2003 Peek
D479,690 S 9/2003 DeGroff
D480,310 S 10/2003 Yourist
6,662,960 B2 12/2003 Hong et al.
6,779,673 B2 8/2004 Melrose et al.
6,796,450 B2 9/2004 Prevot et al.
6,830,158 B2 12/2004 Yourist
7,198,164 B2 4/2007 Yourist et al.
7,334,695 B2 2/2008 Bysick et al.
7,757,874 B2 7/2010 Ross
2001/0037992 A1 11/2001 Tanabe et al.
2002/0008077 A1 1/2002 Lane et al.
2003/0000911 A1 1/2003 Kelley et al.
2004/0016716 A1 1/2004 Melrose et al.
2004/0195199 A1 10/2004 Maki et al.
2004/0195200 A1 10/2004 Bourque et al.
2008/0173613 A1* 7/2008 Ross ..... 215/379

* cited by examiner

THIN WALLED HOT FILLED CONTAINER

CROSS-REFERENCE TO RELATED APPLICATIONS

This application claims the benefit of U.S. Provisional Application No. 61/079,325, filed on Jul. 9, 2008, the entire disclosure of which is incorporated herein by reference.

FIELD

The present disclosure relates to geometric configurations of a container to control container deformation during reductions in product volume that occur during cooling of a hot-filled product.

BACKGROUND

The statements in this section merely provide background information related to the present disclosure and may not constitute prior art. Plastic containers, such as polyethylene terephthalate ("PET"), have become commonplace for the packaging of liquid products, such as fruit juices and liquid sports drinks, which must be filled into a container while the liquid is hot to provide for adequate and proper sterilization. Because these plastic containers are normally filled with a hot liquid, the product that occupies the container is commonly referred to as a "hot-fill product" or "hot-fill liquid" and the container is commonly referred to as a "hot-fill container." During filling of the container, the product is typically dispensed into the container at a temperature of at least 180 degrees F. (82.2 degrees C.). Immediately after filling, the container is sealed or capped, such as with a threaded cap, and as the product cools to room temperature, such as 72 degrees F. (22.2 degrees C.), a negative internal pressure or vacuum forms within the sealed container. Although PET containers that are hot-filled have been in use for quite some time, such containers are not without their share of limitations.

One limitation of PET containers that receive a hot-filled product is that during cooling of the liquid product, the containers may undergo an amount of physical distortion that causes the container to become aesthetically unpleasing, difficult to hold with a human hand, makes the container structurally undesirable, and susceptible to falling over or becoming non-stackable. More specifically, a vacuum or negative internal pressure caused by a cooling and contracting internal liquid may cause the container body or sidewalls to deform in unacceptable ways to account for the pressure differential between the volume inside of the closed container and the space outside, or atmosphere surrounding, the container. To compensate or permit such deformation to be controlled, vacuum panels may be incorporated into the container as portions of the sidewall. Typically, more than one vacuum panel may be employed to control the inwardly moving sidewall of the container during product cooling and container volume displacement. Such vacuum panels may generally be aesthetically unpleasing, limit container sidewall design, restrict convenient placement of sidewall hand grips, and limit container shape and size.

Another limitation of current PET containers that receive a hot-filled product is that they are generally limited to a prescribed wall thickness to limit deformation in particular areas; that is, a wall thickness that can not be thinner or lower than a prescribed value. Such thicknesses are generally necessary to prevent sidewall deformation in prescribed sidewall areas and promote use of the vacuum panels resident in the container sidewall.

Another limitation of current PET containers that employ vacuum panels is that container sidewall areas that do not employ such vacuum panels may be required to be designed with a specific geometry to account for internal vacuum pressures to ensure structural integrity of the sidewall in order to maintain the desired overall container geometry.

Another limitation of plastic containers, such as hot-fill containers, is that deformation in a top location of the container is normally limited since containers are top-loaded and sufficient strength in the top area is necessary to ensure container integrity. Such a limitation means that vacuum accommodating vacuum panels must be located in another area of the container, such as a mid or lower sidewall. Another limitation is that typically when containers undergo deformation in a sidewall, top loading of the container may no longer be possible, thus limiting packaging options for stacking.

Another limitation of hot-filled plastic containers is that such containers may be susceptible to buckling during storage or transit. Typically, to facilitate storage and shipping of PET containers, they are packed in a case arrangement and then the cases are stacked case upon case. While stacked, each container is subject to buckling and compression upon itself due to direct vertical loading. Such loading may result in container deformation or container rupture, both of which are potentially permanent, which may then render the container and internal product as unsellable or unusable.

Yet another limitation with hot-filled containers lies in preserving the body strength of the container during the cooling process. One way to achieve container body strength is to place a multitude of vertical or horizontal ribs in the container to increase the moment of inertia in the body wall in select places. However, such multitude of ribs increases the amount of plastic material that must be used and thus contributes to the overall weight, size and cost of the container. When container walls and vacuum panels are necessary to be a prescribed thickness, limiting container weight presents a challenge. Accordingly, costs associated with container material and costs associated with shipping the container materials, both before and after container manufacture, may be higher than if a lesser amount of container material was able to be used per container, while maintaining container volume.

Finally, current containers do not permit for container shapes other than the standard, largely cylindrical, elongated shape. By permitting other container shapes, beyond what a vacuum panel permits, additional and greater product volume displacements may be afforded to hot-fill containers yet maintaining the integrity of container vertical strength and providing an aesthetically pleasing container.

SUMMARY

A container structure is needed that does not suffer from the above limitations. Accordingly, a hot-fill container that accommodates an internal container vacuum, employs a volume displacing device, utilizes less container material using a thinner container sidewall, is aesthetically pleasing, has desired weight distribution, and improved top loading performance will cure some of the current container limitations.

The present teachings provide a hot-fillable, blow-molded plastic container suitable for receiving a liquid product that is initially delivered into the container at an elevated temperature. The container is subsequently sealed such that liquid product cooling results in a reduced product volume and a reduced pressure within the container. The container is lightweight compared to containers of similar volume yet controllably accommodates the vacuum pressure created in the container from liquid product cooling. Moreover, the container provides excellent longitudinal and horizontal structural integrity and resistance to top loadings from filler valves and vertical forces subjected to the top of the container, such as from top stacking.

A hot-fill container structure may employ a shoulder portion, a body portion, a bottom portion, a plurality of ribs in the body portion that are located next to the bottom portion of the container, and a collapsible portion in the body portion, the collapsible portion located between the shoulder portion and the plurality of ribs. The collapsible portion may be a thin-walled, bag-like structure. The container structure may also employ one or more vacuum panels in the body portion that may lie between the collapsible portion and the bottom portion. The vacuum panels and the collapsible body portion may move toward a central vertical axis when the container is subjected to an internal vacuum pressure. A strengthening groove may lie between the collapsible body portion and the location of the vacuum panels to provide strength to a central portion of the container.

The collapsible portion may be circular in original cross-section or employ molded-in radii to program vacuum movement in the collapsible portion. Part of the collapsible portion may be concave inward toward a central vertical axis of the container while part of the collapsible portion may move away from the central vertical axis. The vacuum panels may displace at least 45 cc of container volume and the collapsible body portion may displace at least 35 cc of volume when the container is subjected to a vacuum. The hot-fill container structure may have a wall thickness in the collapsible body portion of less than 0.019 inches (0.48 mm) thick.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
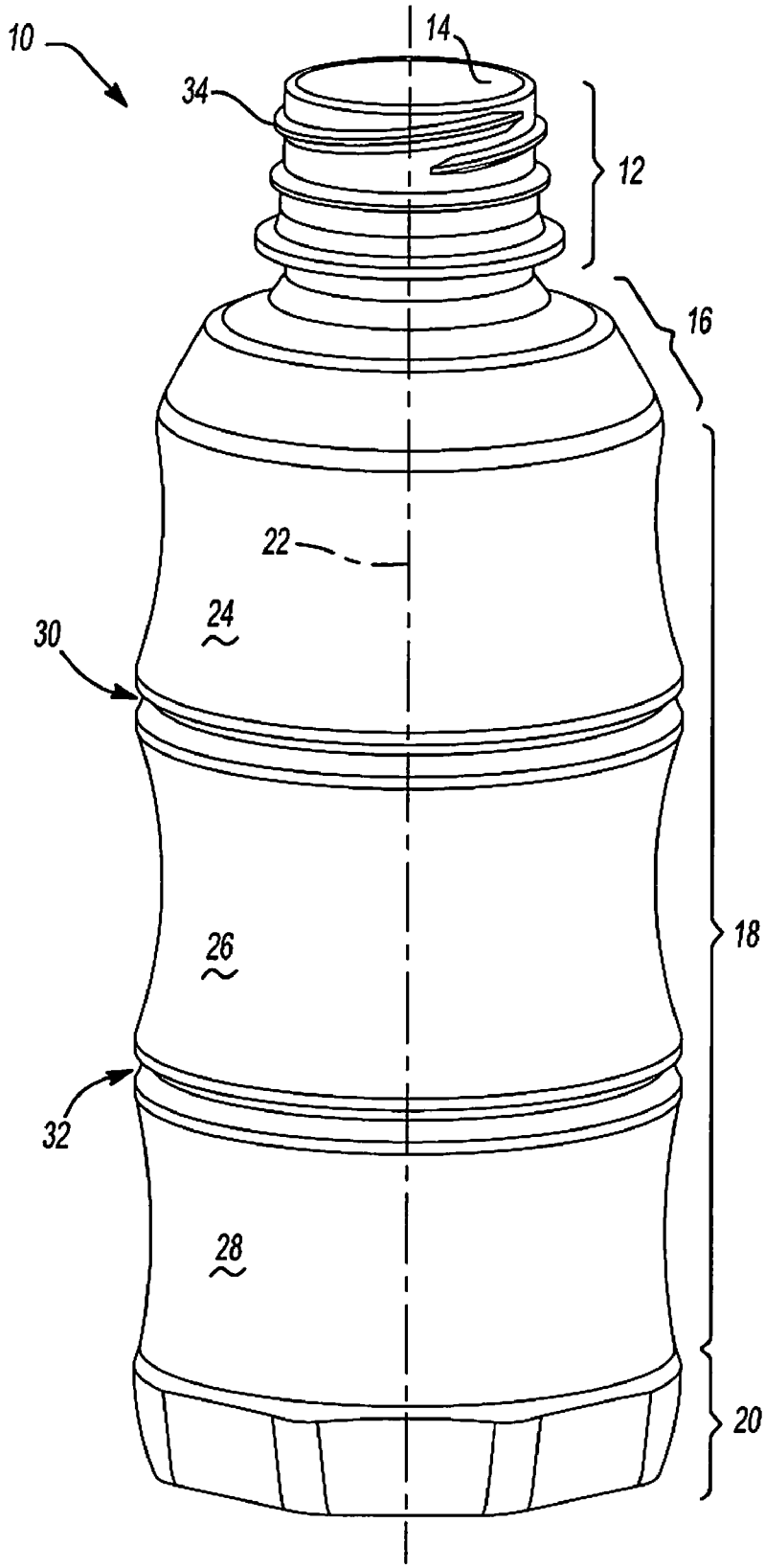
FIG. 1 is a perspective view of a container depicting a sidewall with deformable panels and strengthening rings.

The following description is merely exemplary in nature and is not intended to limit the present disclosure, application, or uses. It should be understood that throughout the drawings, corresponding reference numerals indicate like or corresponding parts and features.

Referring to FIGS. 1-39, teachings of the invention will be presented. FIG. 1 depicts a typical hot-fill container 10 made of a polymer material, such as polypropylene, polyethylene terephthalate (PET), or other polymer materials. The container 10 has a finish portion 12 with a mouth or opening 14 and threads 34 suitable to receive a closure or traditional threaded cap, a shoulder portion 16, a body portion 18, and a bottom portion 20, all having a centerline or central vertical axis 22. The container shoulder portion 16 is generally of a conical shape with a narrower cross section that joins with or forms into the finish portion 12 while the opposite end of the shoulder portion 16 has a larger cross section and meets with the body portion 18. As depicted in FIG. 1, the container 10 may employ or possess three distinct sidewall areas or portions, each part of the body portion 18. For instance, the body portion 18 may employ a first sidewall area 24, a second sidewall area 26, and a third sidewall area 28. Furthermore, the sidewall areas 24, 26, 28 may further be equipped with one or more recessed grooves, which may form slightly raised ribs on either side of the grooves. The grooves may be circular or elliptical, such as groove 30 between sidewall area 24 and sidewall area 26, and groove 32 between sidewall area 26 and sidewall area 28. The grooves 30, 32 themselves may provide a rigid circular or elliptical frame or structure to maintain a desired shape of the container 10 at their locations and act as strengthening grooves or strengthening ribs.

Since the container 10 is designed for "hot-fill" applications, the container 10 may be manufactured out of a polymer or plastic material, such as polyethylene terephthalate (PET), and is heat set enabling such that the container 10 is able to withstand the entire hot-fill procedure without undergoing uncontrolled or unconstrained distortions. Such distortions may result from either or both of the temperature and pressure during the initial hot-filling operation or the subsequent partial evacuation of the container's interior as a result of cooling of the product. During the hot-fill process, the product, such as a fruit juice or sports drink, may be heated to a temperature of about 180 degrees Fahrenheit (82.2 degrees Celsius) or above and dispensed into the already formed container 10 at the elevated temperature(s). After filling, the container 10 may be immediately sealed, such as with a cap, and then cooled. During cooling, the volume of the liquid product in the container 10 decreases which in turn results in a decreased pressure, or vacuum, within the container 10, relative to outside the container. While designed for use in hot-fill applications, it is noted that the container 10 is also acceptable for use in non-hot-fill applications.

In one embodiment, the container 10 may be manufactured from a stretch-molding, heat-setting process such that the polymer material is generally molecularly oriented, that is, the polymer material molecular structure is mostly biaxially oriented. An exception may be that the molecular structure of some material within the finish portion 12 and some material within portions of the bottom portion 20 may not be substantially biaxially oriented.

Figure 2:
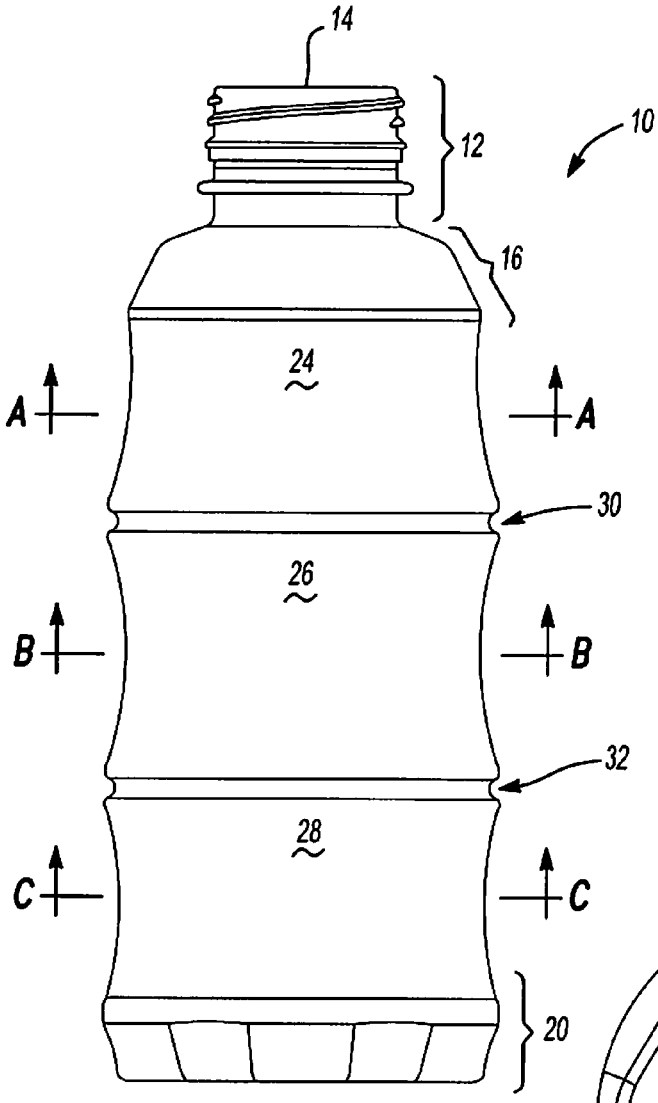
FIG. 2 is a side view of a container depicting a sidewall with deformable panels and strengthening rings.
Figure 3:
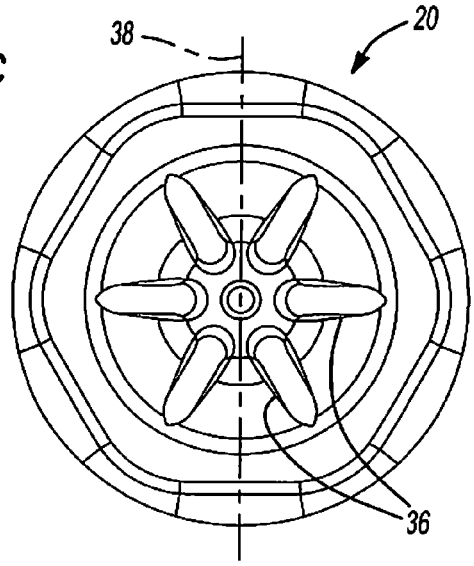
FIG. 3 is a bottom view of a container depicting strengthening ribs.

FIG. 2, similar to FIG. 1, depicts sidewall areas 24, 26, 28, which are thin-walled, bag-like sections of the container 10. The sidewall areas 24, 26, 28 have a wall thickness that is less than that of the shoulder portion 16, finish portion 12, or bottom portion 20 of the container 10. More specifically, the wall thickness of the sidewall areas 24, 26, 28 may be from 0.014-0.018 inches, inclusive, but may be thinner than 0.014 inch and may be thicker than 0.018 inch. Additionally, the sidewall areas 24, 26, 28 may have a wall thickness that is also less than that of the wall thickness at the grooves 30, 32 and just adjacent to each side of the grooves 30, 32. Because the wall thicknesses of the sidewall areas 24, 26, 28 are less than that of other wall thicknesses of the container 10, and moreover, constructed of a thickness to permit deformation during cooling of a hot-filled product, various cross-sectional container shapes, such as polygons, are possible in the sidewall areas 24, 26, 28. Such container cross-sectional shapes will be discussed in more detail later. FIG. 3 is a bottom view of the bottom portion 20 of the container 10 depicting six strengthening ribs 36 within a generally circular configuration about a center point of the bottom surface and about a centerline 38.

Figure 4:
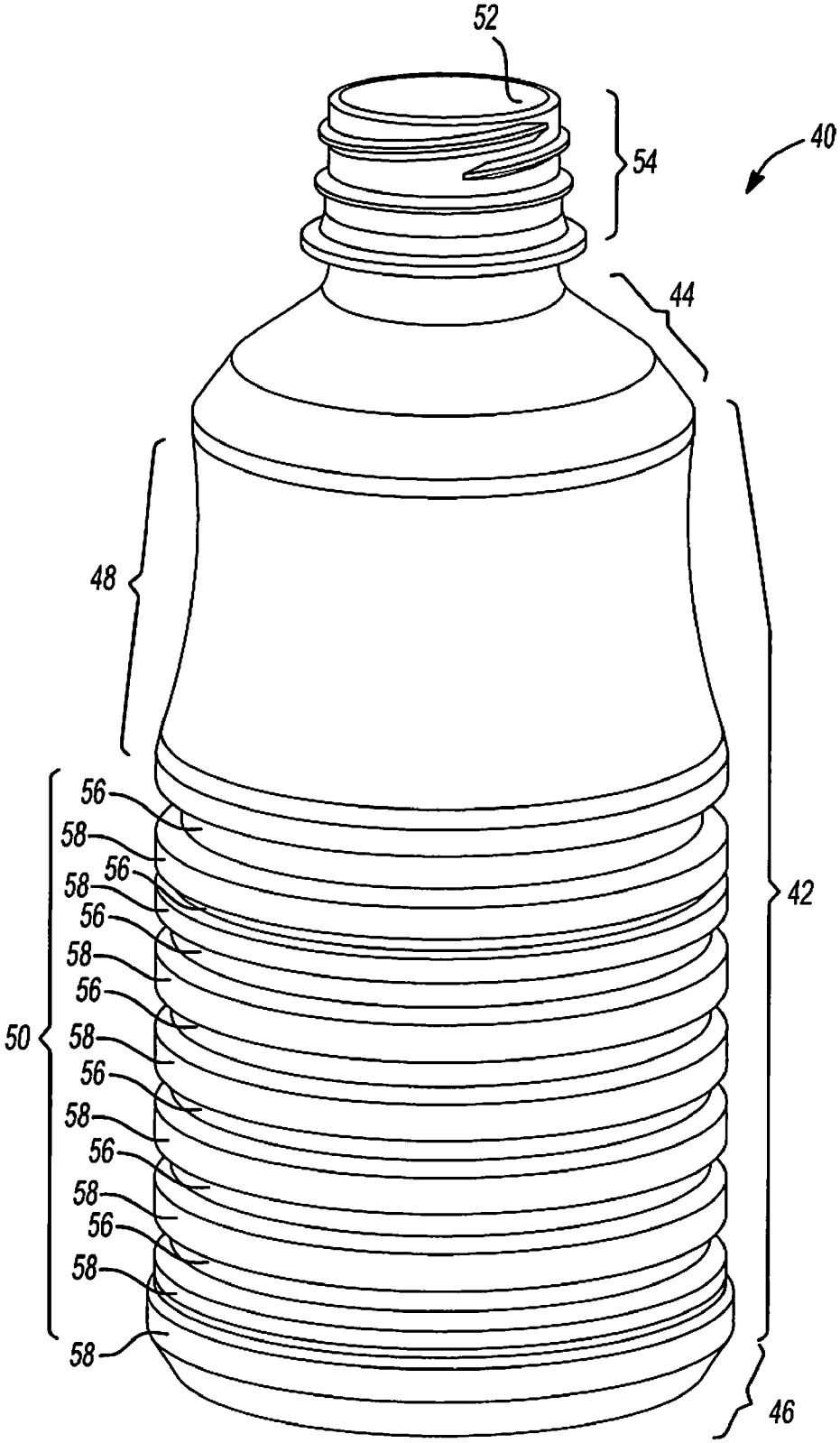
FIG. 4 is a perspective view of a container depicting a sidewall and strengthening ribs.

FIG. 4 depicts a container 40 in which a body portion 42 lies between a shoulder portion 44 and a bottom portion 46. The body portion 42 principally employs two general portions, a sidewall portion 48 and a ribbed portion 50. The ribbed portion 50 may be firmly gripped by a user when drinking or pouring the contents of the container 10 from the opening 52 in the neck portion 54 because ribs 58 and grooves 56 provide strength to the body portion 42 by giving the ribbed portion 50 a higher moment of inertia. The alternating grooves 56 and ribs 58 permit a user to grasp the container 40 without crushing or deforming the ribbed portion 50 of the container. Additionally, the ribbed portion 50 will not deform due to the cooling of the internal hot-fill liquid that results in an internal vacuum within a capped container 40. Additionally, the alternating grooves 56 and ribs 58 provide an aesthetically pleasing look and generate a pleasant tactile feel to the user who grips the ribbed portion 50 of the container, as well as prevent the container 40 from slipping from the hand of one who holds the container 40. With continued reference to FIG. 4, the sidewall portion 48 is a thin-walled, bag-like section that may be thinner than the other walled sections of the container 40. As will be explained in more detail later, the sidewall portion 48 possesses the capability of being vacuum distorted to various positions as a result of the cooling process and its effect of forming a vacuum within the container 40.

Figure 6:
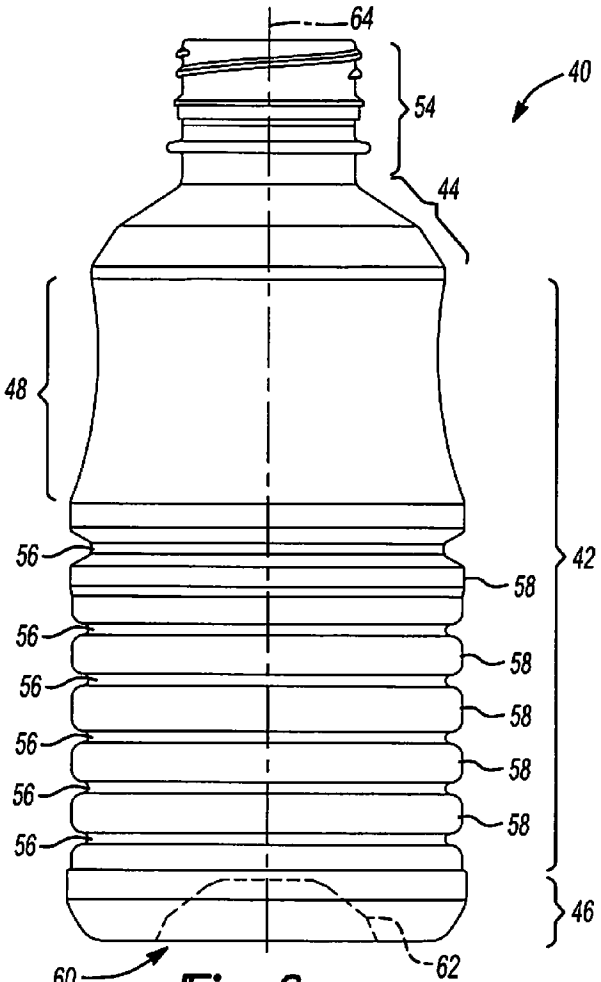
FIG. 6 is a side view of a container depicting a foot area recessed into the bottom of the container.
Figure 5:
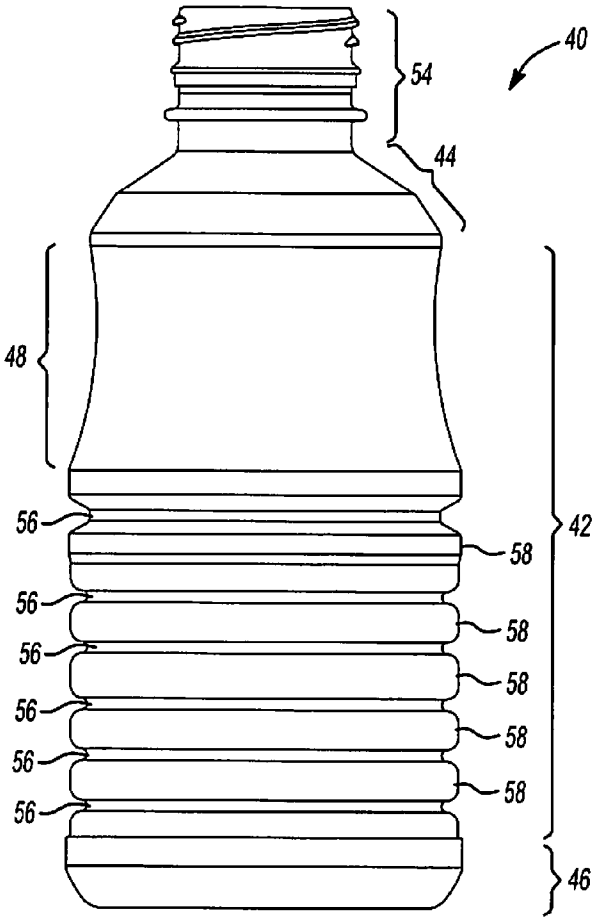
FIG. 5 is a side view of a container depicting a sidewall and strengthening ribs.

FIG. 5 depicts a side view of the container of FIG. 4 and may more clearly depict the relationship between the grooves 56 and ribs 58 in the ribbed portion 50 of the container 40. FIG. 6 is another side view of the container 40 depicting a push up 60 with strength-providing, push up ribs 62 recessed within the bottom portion 46 of the container 40. The geometric shape of the push up 60 and the push up ribs 62 adds strength to the bottom portion 46 of the container 40 to provide proper and adequate support to the entire container for stacking, resting on a surface, etc. The grooves 56 and ribs 58 add strength to the body portion 42 of the container 40 which aids the container 40 in resisting movement or bulging in a lateral direction. Additionally the grooves 56 and ribs 58 aide the body portion 42 in resisting buckling, which may occur when weight is placed on the top of the container, such as upon a capped neck finish portion 54 during product stacking. Instead, any weight placed on top of the container 40 may be absorbed by an accordion style compression of the grooves 56 and ribs 58 to limit any motion to purely vertical motion, such as that which is parallel to a central vertical axis 64.

Regarding the sidewall portion 48 of FIGS. 4-6, the wall thickness is similar or the same as that described above in conjunction with the sidewall areas 24, 26, 28 of FIGS. 1 and 2. The embodiment of FIGS. 4-6 permits vacuum deformation of sidewall portion 48 coupled with the advantages of the ribbed portion 50. That is, deformation localization may be achieved.

Figure 7:
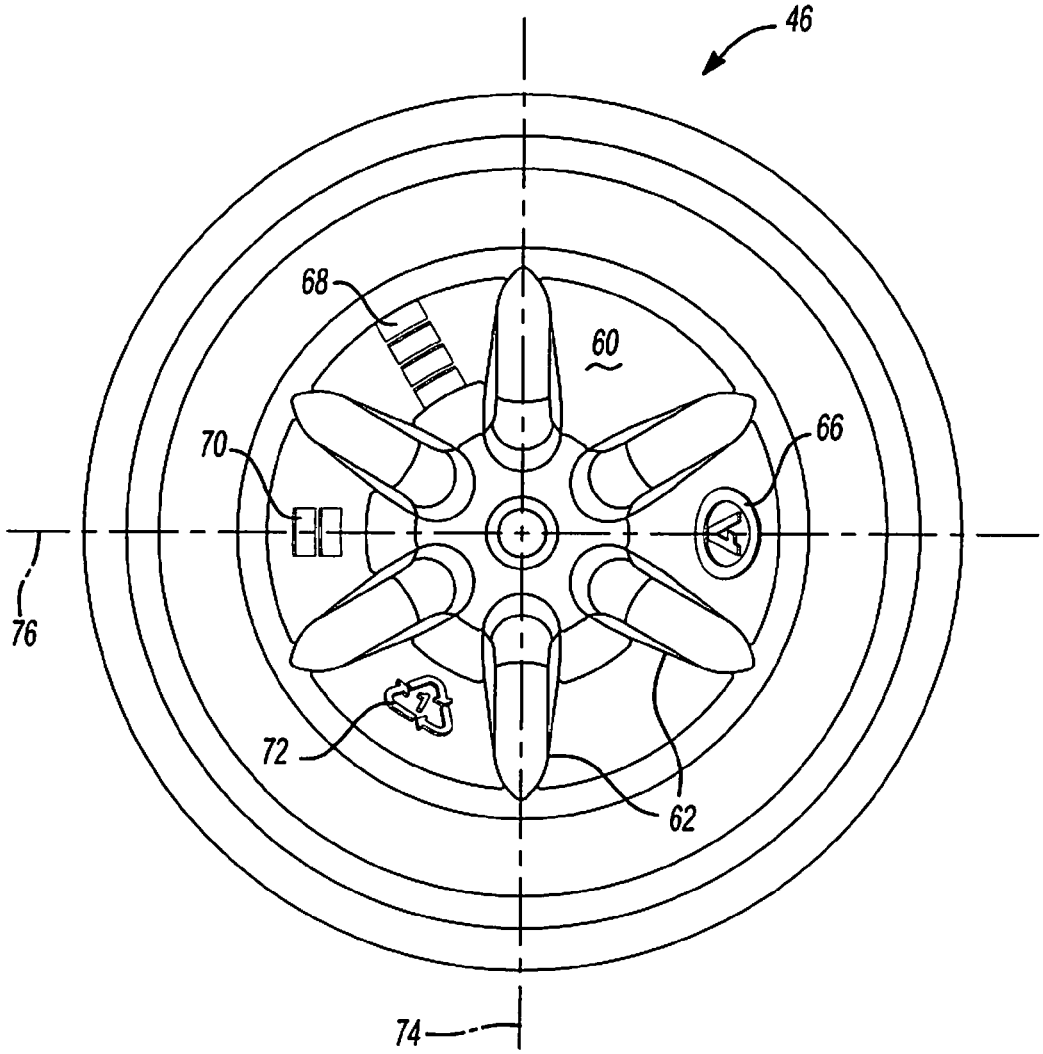
FIG. 7 is a bottom view of a container depicting a bottom portion.

FIG. 7 depicts a bottom view of the container 40 of FIG. 6. More specifically, FIG. 7 depicts a bottom portion 46 and a push up 60 with strength-providing push up ribs 62. The bottom portion is circular and is depicted in four quadrants using a centerline 74 and a centerline 76. Furthermore, identification labels may be molded into the push up 60. For instance, a corporate logo 66, project identification 68, cavity identification 70, and PET recycle logo 72 may all be molded or stamped into the push up 60 in the bottom portion 46.

Figure 9:
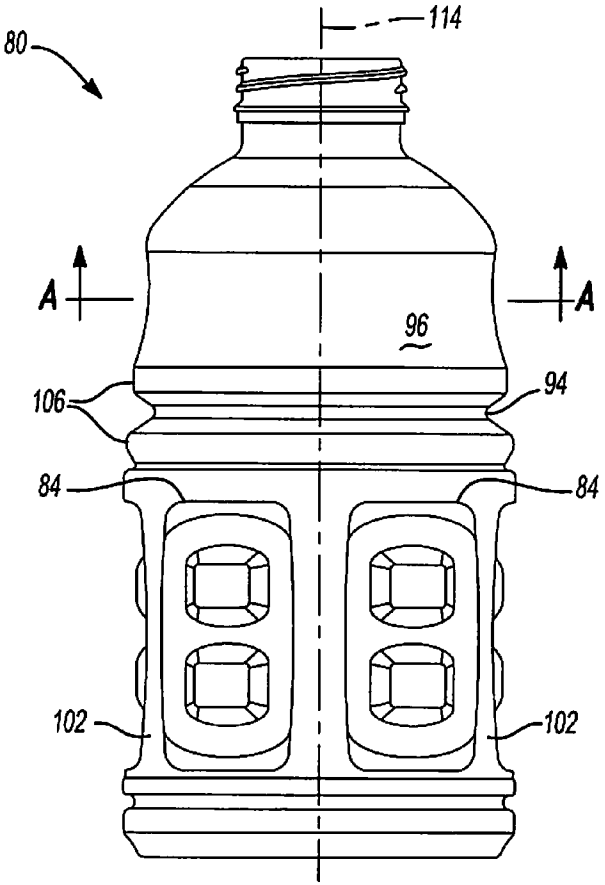
FIG. 9 is a side view of a container depicting vacuum panels.
Figure 8:
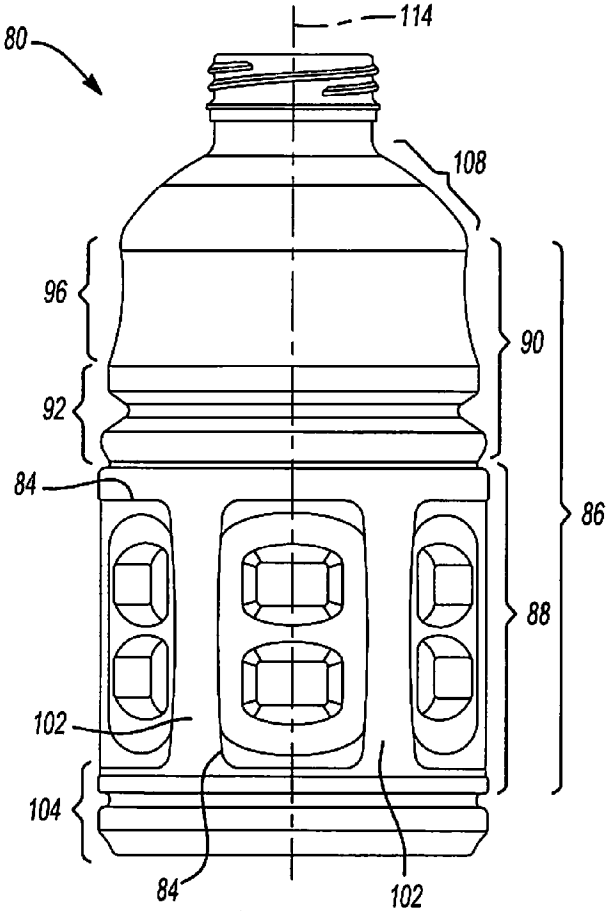
FIG. 8 is a side view of a container depicting vacuum panels.

Turning now to FIGS. 8 and 9, another embodiment of a container 80 is depicted. More specifically, the container 80 may be symmetric about a central vertical axis 114. As depicted, the container 80 may possess one or more vacuum panels 84, which in the case of the present teachings, are identical although such need not be the case, various sizes and styles are possible. The vacuum panels 84 may reside in the body portion 86, and more specifically, in a lower body portion 88. The vacuum panels 84 are generally oval in shape and may extend vertically or longitudinally, such as parallel to the central vertical axis 114, within the lower body portion 88 between the upper body portion 90 and the bottom portion 104 of the container 80. As depicted in FIG. 8, the vacuum panels 84 may be identical, thus when only one is described, one will appreciate that others are identical in function and structure. There may be any number of vacuum panels 84, such as from two to six which may be equally spaced about the container sidewall. The significance of such an arrangement is that an even vacuum "squeeze" or contraction inward toward the central vertical axis 114 is experienced by the lower body portion 88.

The container 80 as described above generally addresses the geometry of the container 80 as it is originally formed. The discussion will now focus on changes in the structure or shape of the container 80 after hot-filling the container 80 and also during cooling of the liquid. After a hot liquid product is filled into the container 80, the container 80 is immediately capped and begins cooling, which begins the cooling process of the product and thus a gradual decrease in volume of the product. The reduction in product volume during cooling produces a reduction in pressure within the container 80 and begins to exert contraction forces on the interior wall(s) of the container 80, such as toward the central vertical axis 114 of the container 80. The vacuum panels 84 of the container 80 may controllably accommodate this pressure reduction by being equally drawn or contracted inwardly, in the event the vacuum panels are all of the same dimensions, toward the central vertical axis 114 of the container 80. The overall external surface area of the container 80 that the vacuum panels 84 occupy facilitates the ability of the vacuum panels 84 to accommodate a significant amount of the reduced pressure or vacuum. Moreover, the surface of the vacuum panels 84 may be configured such that they absorb or account for a specific internal pressure or vacuum upon cooling of the liquid.

As the vacuum panels 84 move or contract inwardly toward the central vertical axis 114, the generally circular shape of the lower body portion 88 permits or causes columns 102 to maintain the generally circular structure of the container 80 such that the entire lower body portion 88 does not move inwardly. Thus, the columns 102 do not appreciably deflect radially inward or outward from their position, regardless of whether the container 80 is not filled or filled, which is when the container is hot-filled, capped and cooled. Additionally, a decorative embossed motif or word, such as a company name or drink name, may be molded into the columns 102 to enhance vertical and lateral strength of the columns 102. That is, increasing the moment of inertia of the columns by molding a three-dimensional name or design into the columns 102 may increase their strength in multiple directions. The bottom portion 104 supports the entire container 80 when the container is resting in an upright position on a surface, such as a table, and may further employ grooves or ribs to provide strength to the bottom portion 104.

Continuing with FIGS. 8 and 9, above the lower body portion 88, an upper body portion 90 employs a collapsible body portion 96 and a transition portion 92. The transition portion 92 lies between the collapsible body portion 96 and the lower body portion 88 and employs a groove 94 along with upper and lower raised portions or ribs 106 to provide strength to the container body portion 86. More specifically, the strength that the groove 94 and ribs 106 provide, coupled with the strength of the bottom portion 104, provides sufficient strength on the upper and lower sides of the lower body portion 88 to maintain the circular shape of the container 80 as the vacuum panels 84 expand and contract between the transition portion 92 and the bottom portion 104. Just above the transition portion 92 and below a shoulder portion 108, lies the collapsible body portion 96. Before explaining the collapsible body portion 96, it should be noted that the shoulder portion 108 is sufficiently strong such that it will not collapse and also maintains a rigid circular structure at the juncture of the shoulder portion 108 with the collapsible body portion 96.

Turning now mainly to FIGS. 9-16, details of the collapsible body portion 96 will now be presented. The collapsible body portion 96 is a thin-walled, bag-like structure, relative to the thicknesses of the wall structures of other areas of the container 80. The collapsible body portion 96 is thin enough to be and appear bag-like (e.g. collapsible under its own weight) after the container 80 is molded, but before it is hot-filled and capped. More specifically, the collapsible body portion 96 may collapse upon itself, randomly or in an accordion-like or folding fashion, toward the ribs 106 of the transition portion 92. One advantage of the thin-walled, collapsible, bag-like structure of the collapsible body portion 96 is that less material may be used in the overall construction of the container 80. This will permit the container 80 to be manufactured with lower material costs than if the entire container 80 were made using a thickness thicker than the collapsible body portion 96, such as a thickness equal to that of the balance of the container 80. Additionally, because the collapsible body portion 96 is flexible, it will respond to a vacuum that forms inside the container 80 thus causing the container 80 to displace volume.

Figure 10:
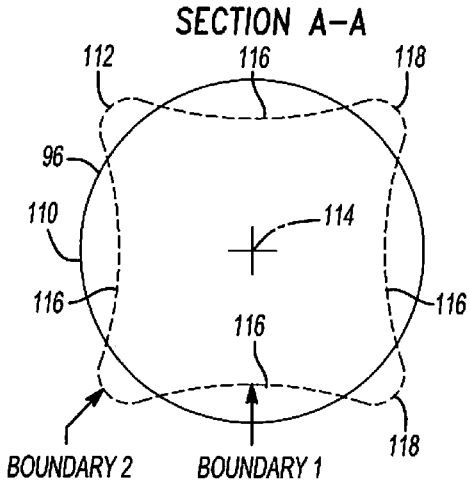
FIG. 10 is a cross-sectional view depicting container sidewall boundaries of section A-A in FIG. 9.
Figure 11:
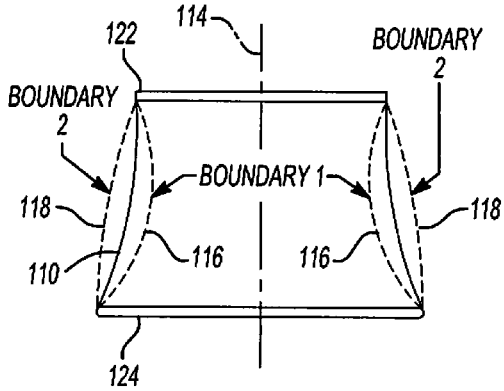
FIG. 11 is a side view depicting container boundaries of a shoulder portion in FIG. 9.

FIG. 9 depicts the collapsible body portion 96 with section A-A denoted, which will now be further explained. Turning to the cross-section of FIG. 10, a first example of the collapsible body portion 96 will be explained. The collapsible body portion 96 in its as-molded shape 110 is depicted in cross section in FIG. 10. That is, in the as-molded, circular form depicted, the collapsible body portion 96 may be rigid enough to support its own weight and remain in an upright position, as depicted in FIG. 9. FIG. 10 depicts a cross-sectional shape 112 of the collapsible body portion 96 after the container 80 is hot-filled, capped and cooled. More specifically, upon cooling of the liquid contents of the hot-filled container, the collapsible body portion 96 may begin to randomly collapse, deform or form itself into a different cross-sectional shape, as depicted by reference numeral 112, compared to the as-molded cross-sectional shape 110.

The reason for the change in cross-sectional shape of the container 80 is due to the cooling of the hot-filled liquid inside the container 80. More specifically, upon filling the container 80 with a hot liquid and capping the container 80, the liquid contents will begin to cool. The process of cooling causes the liquid to contract, which displaces volume within the container. Although the container 80 may be equipped with one or more vacuum panels 84, upon the vacuum panels reaching or attaining their maximum amount of movement, the internal volume of the container 80 may continue to decrease. With such a decrease continuing, the thin-walled, bag-like, collapsible body portion 96 may be drawn toward the central vertical axis 114 of the container 80. More specifically, and with added reference to the side view of FIG. 11, the thin-walled portion of the collapsible body portion 96 may be drawn toward the central vertical axis 114 as noted by collapsible wall 116.

Another advantage and feature of the collapsible body portion 96, is that it is capable of moving away from the central vertical axis 114 when the container 80 is cooled. More specifically, the as-molded cross-sectional shape 110 may undergo deformation away from the central vertical axis 114. That is, the collapsible body portion 96 may become convex or outwardly bulged upon cooling, as depicted with bulged, convex walls 118. Thus a variety of random shapes are possible. This is an advantage over a container having thick walls, where the walls will not outwardly bulge. With convex or outwardly bulged, convex walls 118, the capped container 80 may continue to cool and contract the hot liquid inside the container, thus causing the convex shaped walls to draw in, becoming concave, collapsible wall 116. The as-molded shape 110 shown in FIG. 10, when being drawn inwardly toward the central vertical axis 114, is capable of taking on the cross sectional shape 112 depicted with dashed lines in FIG. 10. Other shapes are possible. One should note that in the figures, the inwardly curved or concave shaped portions are noted as "Boundary 1", while the outwardly projected portions are noted as "Boundary 2", correspond to the "Boundary 1" and "Boundary 2" portions in their accompanying side views (e.g. FIGS. 10 and 11, FIGS. 12 and 13). Also, in FIG. 11, shoulder to collapsible body transition area 122 and collapsible body to body transition area 124 are noted, and provide rigidity to the collapsible body portion 96.

Figure 12:
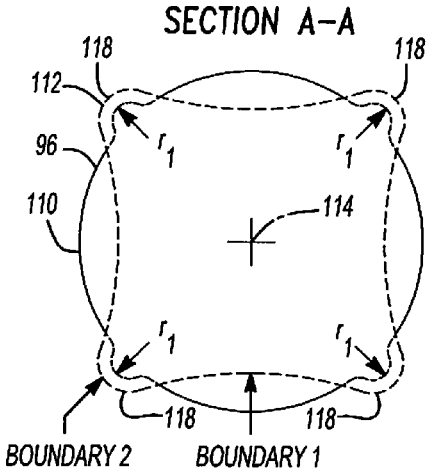
FIG. 12 is a cross-sectional view depicting container sidewall boundaries of section A-A in FIG. 9.
Figure 13:
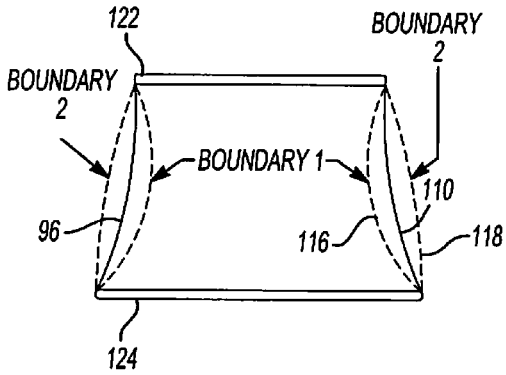
FIG. 13 is a side view depicting container boundaries of a shoulder portion of FIG. 9.

Turning now to FIG. 12, which depicts section A-A of FIG. 9, another aspect of the teachings will be explained. More specifically, the as-molded shape 110 shown in FIG. 10 may have small radii $r_1$ molded into the container 80 when it is manufactured which form protrusions. FIG. 12 notes the radii $r_1$ that protrude away from the central vertical axis 114 in the otherwise circular cross-section of the molded shape 110 of the collapsible body portion 96. More specifically, when the radii $r_1$ are molded into the container 80 upon initial container manufacture, the collapsible body portion 96 is "programmed" to transform into the cross-sectional profile shape 112 noted in FIG. 12, upon cooling of a hot-fill liquid. The protrusions hasten movement in the collapsible body portion 96 when the volume of the container is subjected to a vacuum pressure. The collapse or drawing in of the collapsible body portion 96 can be controlled by placement of the radii $r_1$, which actually cause the cross-sectional profile shape 112 to outwardly protrude. The side view of FIG. 13 is similar to that of FIG. 11 in that "Boundary 1" and "Boundary 2" of FIG. 12 correspond to "Boundary 1" and "Boundary 2" of FIG. 13. Additionally, when viewed in a side view, the collapsible body portion 96 of container 80 in FIG. 13 depicts the as molded shape 110 that is deformable due to the internal vacuum of the container to a drawn-in collapsible wall 116 and a protruded, bulged, convex wall 118.

Figure 14:
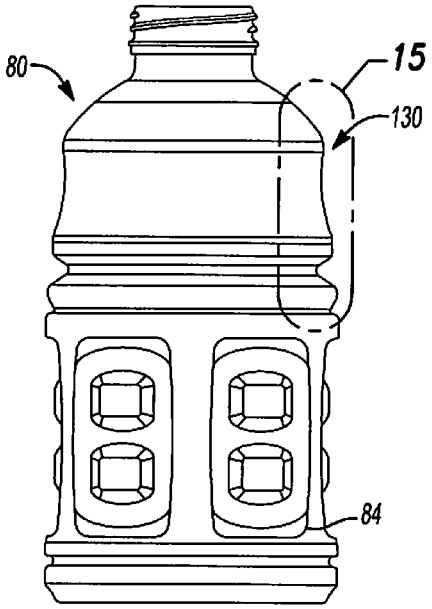
FIG. 14 is a side view of a container depicting and employing a side panel and vacuum panels.
Figure 15:
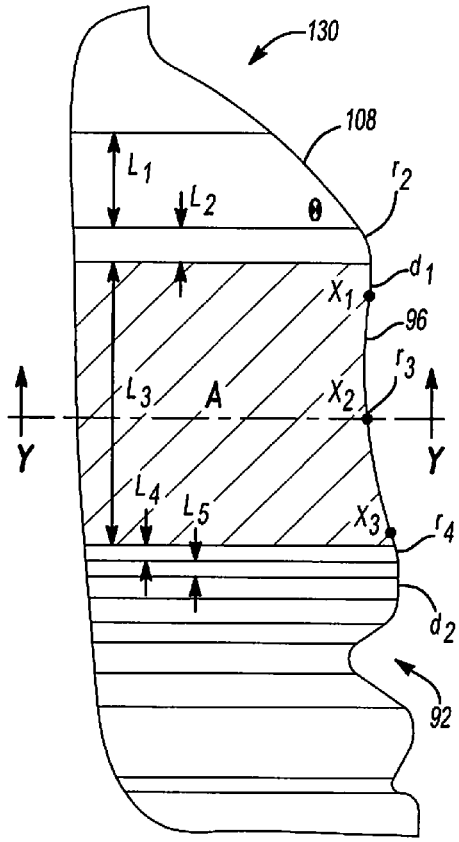
FIG. 15 is an enlarged view of the shoulder and side panel area of the container of FIG. 14.
Figure 16:
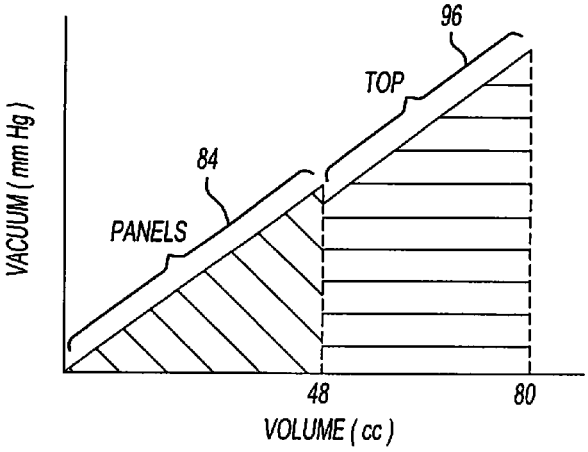
FIG. 16 is a graph of vacuum versus volume for the container of FIGS. 14 and 15.

Turning now to FIG. 14, the container 80 is depicted with a collapsible panel and shoulder area 130 circled, and a vacuum panel 84, while FIG. 15 depicts the enlarged shoulder area 130. More specifically, details of the enlarged shoulder area 130 which includes shoulder portion 108, collapsible body portion 96, and transition portion 92 of FIG. 15 that permit the collapsible body portion 96 to deform under vacuum pressure to different cross sectional profiles will now be discussed. Before presenting specific details of how specific container profiles may be achieved, FIG. 16 depicts graphical results of the vacuum performance of the hot-filled container 80 of FIGS. 14 and 15. More specifically, FIG. 16 is a graph of Vacuum Pressure in millimeters of Mercury (mm Hg) versus Volume in cubic centimeters (cc). The area under the "panels 84" curve represents, at room temperature, the volume of liquid displaced by the container 80 using only vacuum panels 84, such as five (5) vacuum panels and no collapsible body portion 96. Thus, without the collapsible body portion 96 the container 80 may displace 48 cc of container volume with hot-fill liquid inside. However, by adding the collapsible body portion 96 to the top of the container 80 ("top 96" on FIG. 16), the displacement of volume increases to 80 cc. That is, the collapsible body portion 96 permits an additional 32 cc of volume displacement to the container 80, which represents an increase in volume displacement of 67%. The collapsible body portion 96 thus permits further control and localization of the collapse or contraction of the container 80. That is, the collapsible body portion 96 transforms from a circular, as-blown container wall to a polygonal wall cross-sectional profile with container walls drawn inwardly toward a container central vertical axis and some protruding outwardly away from a container central vertical axis. By controlling the location of the contraction of the container by using a thinner container wall at various locations, the wall section to deform may be specifically located to an area of the container, and the material used to make the container may be reduced, compared to a comparable non-deforming container.

Continuing with FIG. 15, the variables $L_1$, $L_2$, $L_3$, $L_4$, $L_5$, $x_1$, $x_2$, $x_3$, $d_1$, $d_2$, $\theta$ (theta), $r_2$, $r_3$ and $r_4$ may each have a prescribed numerical value that permits the container 80 to yield the specific geometric shapes, which permit the volume displacing properties noted in FIG. 16. Continuing, values of the above FIG. 15 variables to arrive at the 67% increase in volume displacement discussed above may be $d_1$ equals 3.336 inches (84.73 mm), $d_2$ equals 3.622 inches (91.99 mm), $x_1$ equals 0.015 inches (0.38 mm), $x_2$ equals 0.014 inches (0.35 mm), and $x_3$ equals 0.018 inches (0.45 mm). The variables $d_1$ and $d_2$ represent container diameters, while $x_1$, $x_2$, and $x_3$ represent material wall thicknesses at their depicted locations shown in FIG. 15. Additionally, if the weight of an area "A" were measured, the weight may be 3.7 grams. The area "A" represents the material volume of the collapsible body portion 96 and also the general area of the collapsible body portion 96 around the periphery or circumference of the container 80. The cross-section Y-Y through point $x_2$ has an as-blown shape denoted by shape 110 of FIG. 10 and an after hot-filled and cooled shape in accordance with shape 112. The transition portion 92 and the shoulder portion 108 may have a wall thickness that is thicker than the wall thickness of the collapsible body portion 96 for added strength.

Figure 17:
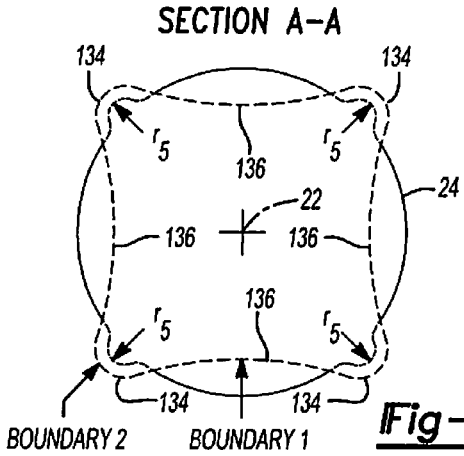
FIG. 17 is a cross-sectional view of section A-A of FIG. 2.
Figure 18:
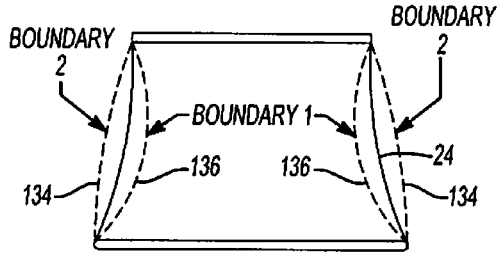
FIG. 18 is a side view depicting container boundaries of a shoulder portion of FIG. 2.

Turning now to FIGS. 17-28, and with reference to FIG. 2, which depicts the container 10, additional specific cross-sectional and side views of geometries of the container 10 will be presented. The container 10 of FIG. 2 depicts three sidewall areas 24, 26, 28 that are also separate, thin-walled, bag-like collapsible body portions. The wall thicknesses and other container dimensions of the collapsible body sidewall areas 24, 26, 28 may be similar to or the same as the dimensions noted in FIG. 15. Regardless, the wall thicknesses will be thin enough for a given container, a liquid product, its cooling rate and the progressive and resulting internal vacuum pressure. Continuing, FIG. 17 depicts an as-molded cross-sectional shape of the cross-section A-A of FIG. 2 and an after-molded cross-sectional shape. Radii $r_5$ denote a specific radius that is molded into the container 10 before it is hot filled. Radii $r_5$ causes or "programs" the container sidewall area 24 to begin bulging and continue bulging or protruding in the direction of the bulge, away from the central vertical axis 22 of the container 10. The container at the location of radii $r_5$ may be thought of as a vertical column 134 within the sidewall area 24. That is, as the vacuum pressure within the container 10 increases, the column 134 or cross-sectional corner provides strength due to its shape and orientation that promotes deformation at another area, such as at concave walls 136 between the columns 134. Concave walls 136 begin to move inward, in a concave fashion, toward the central vertical axis 22 as columns 134 move outward. Thus, columns 134 are a structural area that is able to resist, to a certain degree, the forces resulting from the vacuum pressure. The resulting transformation from the as-molded circular shape with radii $r_5$ to the resulting protruding columns 134 and concave walls 136 is not only aesthetically pleasing, but functional in responding to the internal vacuum pressure of the container. FIG. 18 is a side view of the container 10 depicting the deformable sidewall area 24. More specifically, the sidewall area 24 depicts the as-molded location of the sidewall area 24 of the container 10, while the wall 136 represents the concave inward portion of the sidewall area 24 and the columns 134 represents the columns or corners of the sidewall area 24 when the sidewall area 24 is subject to an internal vacuum pressure. The wall 136 is noted with "Boundary 1" while columns 134 are noted with "Boundary 2".

Figure 19:
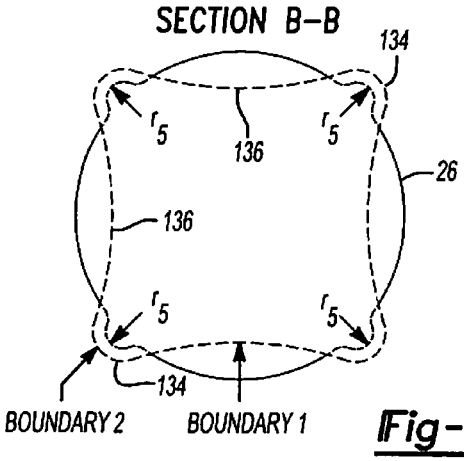
FIG. 19 is a cross-sectional view of section B-B of FIG. 2.
Figure 20:
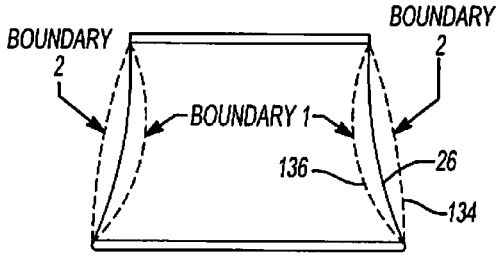
FIG. 20 is a side view depicting container boundaries of a sidewall portion of FIG. 2.
Figure 21:
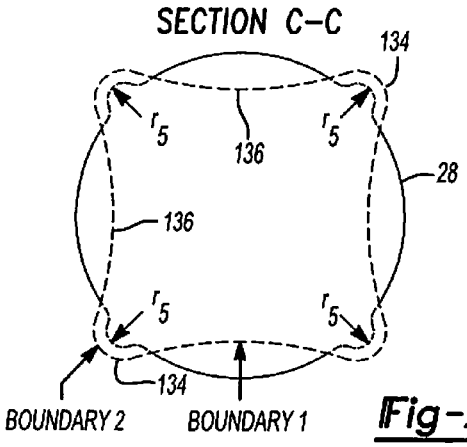
FIG. 21 is a cross-sectional view of section C-C of FIG. 2.
Figure 22:
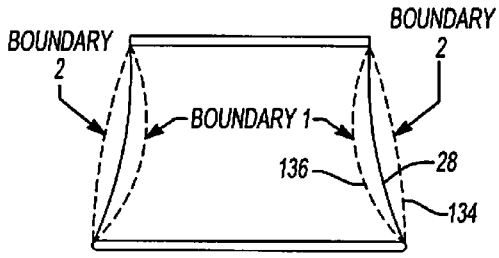
FIG. 22 is a side view depicting container boundaries of a sidewall portion of FIG. 2.

FIG. 19 depicts a cross-sectional view of the sidewall area 26 at the section B-B of FIG. 2 while FIG. 20 depicts a side view of the sidewall area 26 noting the locations of the protruding radii $r_5$ sections. Similarly, FIG. 21 depicts a cross-sectional view of the sidewall area 28 at the section C-C of FIG. 2 while FIG. 22 depicts a side view of the sidewall area 28 noting the locations of the protruding radii $r_5$ sections ("Boundary 2") and concave sections ("Boundary 1"). It should be noted that sections B-B and C-C are depicted as identical to section A-A, although such does not need to be the case. Different radii, such as $r_5$, may be programmed into the molded container 10 in each of the various sections, A-A, B-B and C-C or they may be made the same. The criteria upon which the radii are programmed into the mold for the container 10 may be the size of the container 10, how the container 10 will be held by a user, the cooling rate and degree of vacuum created within the container 10, etc. Other criteria are foreseeable. Because the sidewall areas 24, 26, 28 are each and all collapsible, areas in the container 10 to secure the containers overall cylindrical shape are present and include the shoulder portion 16, groove 30, groove 32, and bottom portion 20. The items indicated by reference numerals 16, 30, 32, and 20 may be constructed such that they are non-collapsible and have a wall thickness thicker than the collapsible areas, and have a curvature or structure that resists motion toward the central vertical axis 22 of the container 10.

Figure 23:
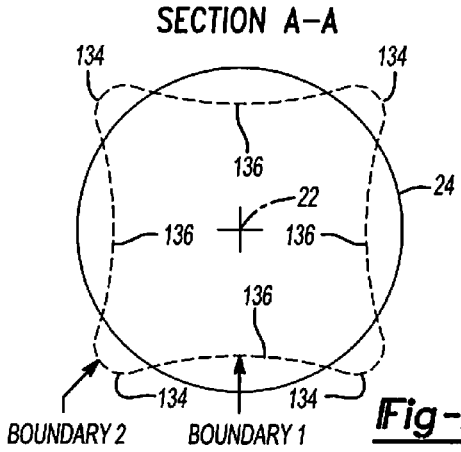
FIG. 23 is a cross-sectional view of section A-A of FIG. 2.
Figure 24:
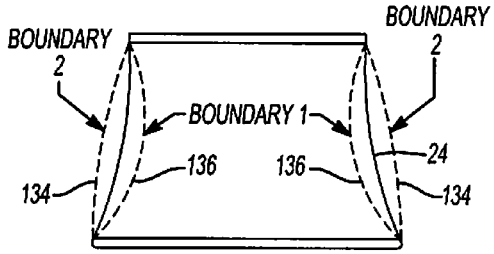
FIG. 24 is a side view depicting container boundaries of a shoulder portion of FIG. 2.
Figure 25:
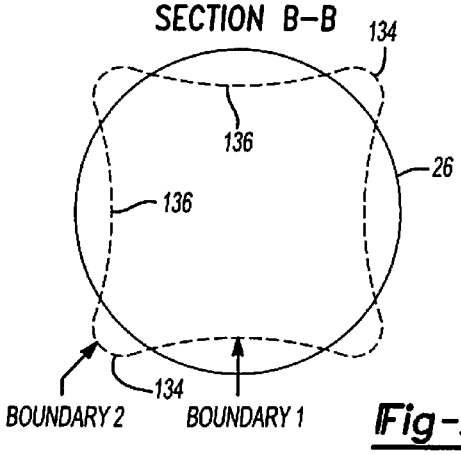
FIG. 25 is a cross-sectional view of section B-B of FIG. 2.

While FIGS. 17-22 depict programmable radii $r_5$, such radii do not need to be programmed or designed into the container 10. More specifically, the container 10 may be designed with no radii in its as-molded and pre-filled state, as depicted in FIGS. 23, 25 and 27 with reference to sidewall areas 24, 26 and 28, respectively. Continuing with FIG. 23, the cross-sectional view of section A-A of FIG. 2 depicts the as-molded state of the container 10 with solid lines and the after-cooled state of the container with dashed lines. The same is true for FIGS. 24-28. While FIG. 23 generally depicts a four-sided after-molded piece, the after-molded shape of the sidewall area 24 is random in FIGS. 23, 25 and 28 because there is no programming of the original container as there is in FIGS. 17, 19 and 21. Thus, the after-molded shape of the container depicted in FIGS. 23, 25 and 27 does not have to be four sided, and may take on a variety of shapes, such as any symmetrical or non-symmetrical shape, or any random shape. FIG. 24 depicts using a dashed line what are effectively columns 134 and walls 136 of the after-molded shape. The area bounding, above and below, the sidewall area 24 is a rigid structure that does not effectively move toward the central vertical axis 22.

Figure 26:
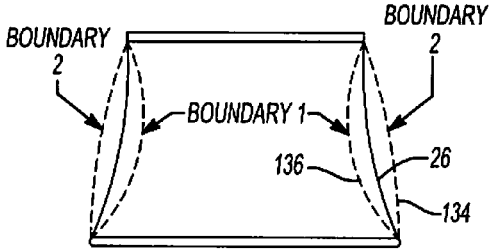
FIG. 26 is a side view depicting container boundaries of a sidewall portion of FIG. 2.
Figure 27:
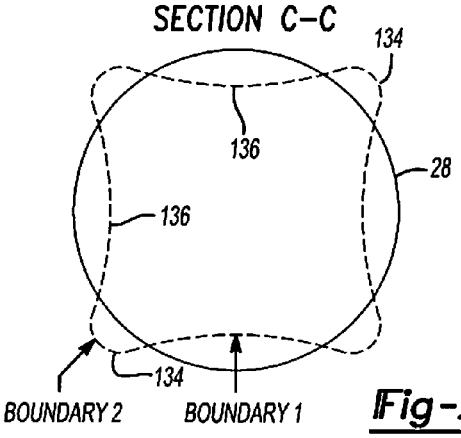
FIG. 27 is a cross-sectional view of section C-C of FIG. 2.
Figure 28:
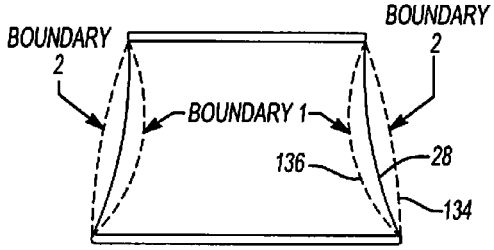
FIG. 28 is a side view depicting container boundaries of a sidewall portion of FIG. 2.

FIG. 25 depicts a cross-sectional view of the sidewall area 26 at the section B-B of FIG. 2 while FIG. 26 depicts a side view of the sidewall area 26. Similarly, FIG. 27 depicts a cross-sectional view of the sidewall area 28 at the section C-C of FIG. 2 while FIG. 28 depicts a side view of the sidewall area 28. It should be noted that sections B-B and C-C are depicted as identical to section A-A, although such does not need to be the case and other random shapes are possible. "Boundary 1" and "Boundary 2" indicated in FIG. 23 correspond to FIG. 24. Similarly, "Boundary 1" and "Boundary 2" of FIG. 25 correspond to FIG. 26 while "Boundary 1" and "Boundary 2" of FIG. 27 correspond to FIG. 28.

Figure 29:
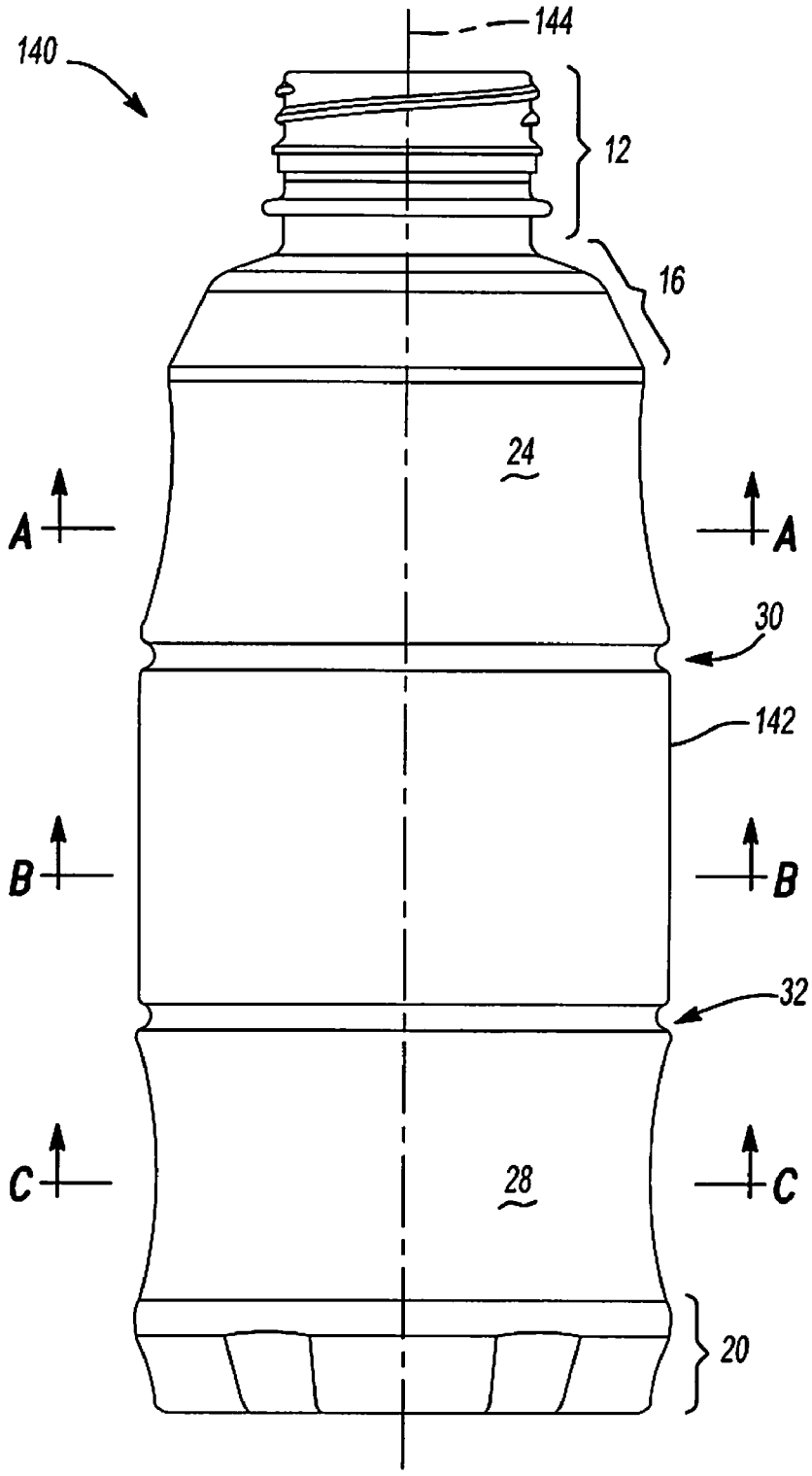
FIG. 29 is a side view of a container depicting a sidewall with deformable panels, strengthening rings and a label panel.

Turning now to FIGS. 29-39, another embodiment of the invention is depicted. More specifically, FIG. 29 depicts a container 140 having much of the same components and features of the container 10 shown in FIGS. 1 and 2, with the exception of a rigid label panel 142. The rigid label panel 142 is a rigid, non-deformable area of the hot fill container and because the rigid label panel 142 does not deform, regardless of any expansion and contraction experienced in other areas of the container 140, an adhesive label may be applied to the panel without concern that it may become wrinkled, torn or fall off from any expansion, contraction or contortion of the container 140, such as during a vacuum pressure change within the capped container 140 after hot-filling with a liquid product.

The container 140 of FIG. 29 is essentially the same as the container 10 of FIG. 2 with the exception of the rigid label panel 142 instead of a collapsible sidewall area 26 (FIG. 2). Continuing, the container 140 has a neck finish portion 12, a shoulder portion 16, a collapsible sidewall area 24, a collapsible sidewall area 28, and a bottom portion 20, all positioned symmetrically about a central vertical axis 144. The container 140 also employs a groove 30 and groove 32 which serve to help the container 140 maintain its circular structure since each has an adjacent collapsible sidewall area 24, 28.

Figure 30:
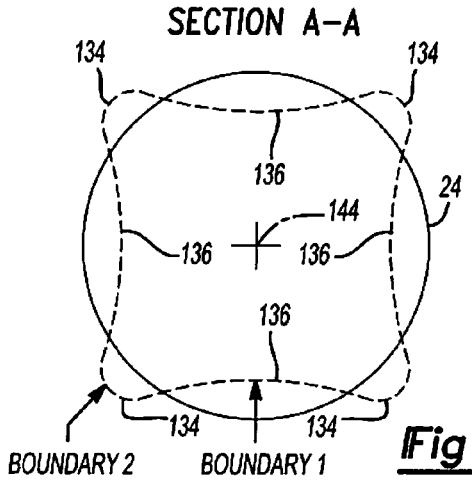
FIG. 30 is a cross-sectional view of section A-A of FIG. 29.
Figure 31:
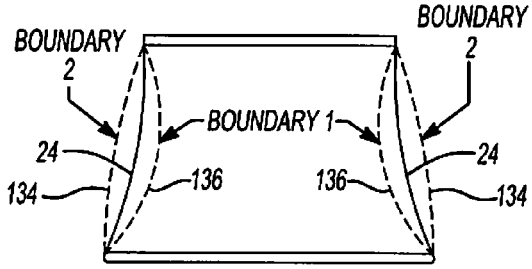
FIG. 31 is a side view depicting container boundaries of a shoulder portion of FIG. 29.

Turning now to FIG. 30, the cross-section A-A of FIG. 29 is depicted. In FIG. 30, the solid circular line depicts the as-molded and pre-filled container cross-section A-A of the container 140, while the dashed line depicts the capped, after-cooled geometry of the container 140. As discussed above in another embodiment, the ending geometry of the sidewall areas 24 and 28 of the container 140 may be random, since no "programming" of the as-molded container walls with internal radii is depicted. As such, a variety of geometries in the final cross-section are possible and not all geometries may be symmetrical about the central vertical axis 144. The geometry depicted in FIG. 30 has a column 134 which is a structural area that is better able to resist the forces resulting from the vacuum pressure within the container 140. The resulting transformation from the as-molded circular shape of the sidewall area 24 to the resulting protruding columns 134 and concave walls 136 is not only aesthetically pleasing, but functional in responding to the internal vacuum pressure. FIG. 31 is a side view of the container 140 depicting the deformable as-molded sidewall area 24. Continuing, the walls 136 depicts the after-filled concave inward portion of the sidewall area 24 of the container 140, while the columns 134 represents the column or corners of the sidewall area 24 when the sidewall area 24 is subject to an internal vacuum pressure. The walls 136 are noted with "Boundary 1" while the columns 134 are noted with "Boundary 2", both of which are depicted on FIGS. 30 and 31.

Figure 32:
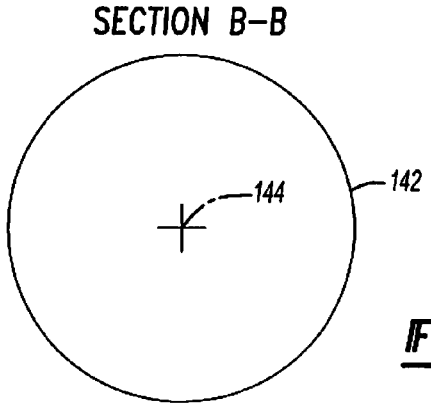
FIG. 32 is a cross-sectional view of section B-B of FIG. 29.

FIG. 32 depicts the rigid label panel 142 at section B-B of the container 140 of FIG. 29. The rigid label panel 142 does not undergo deformation during cooling of a hot-fill liquid within the container 140. Referring to FIG. 29, the wall thickness of the rigid label panel 142 is thicker than that of the collapsible sections, such as sidewall area 24 and sidewall area 28, since resisting deformation during container content cooling requires a thicker and stronger sidewall.

Figure 33:
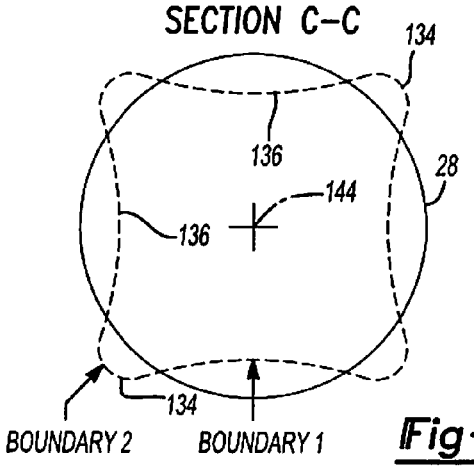
FIG. 33 is a cross-sectional view of section C-C of FIG. 29.
Figure 34:
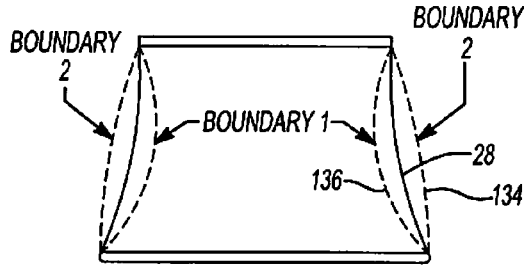
FIG. 34 is a side view depicting container boundaries of a sidewall portion of FIG. 29.

FIG. 33 depicts a structure similar to FIG. 30, while FIG. 34 depicts a structure similar to FIG. 31. Because of the similarity, details of FIGS. 33 and 34 will not be discussed; however, a difference between the structures of FIGS. 30 and 31, vis-à-vis FIGS. 33 and 34, is the location of each structure in the container 140. The collapse of the sidewall of FIG. 30

(section A-A) and FIG. 33 (section C-C) is random, which means that the geometric shape may or may not be symmetrical with the central vertical axis 144. A variety of geometric shapes are conceivable.

Figure 35:
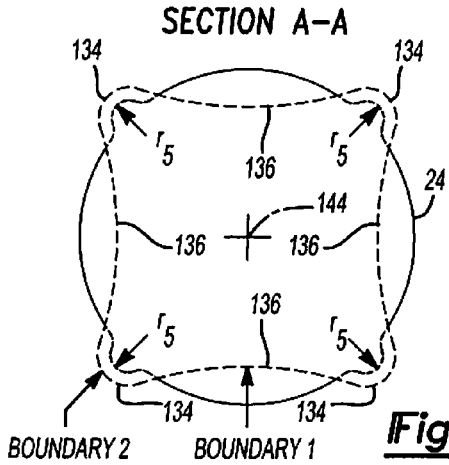
FIG. 35 is a cross-sectional view of section A-A of FIG. 29.
Figure 36:
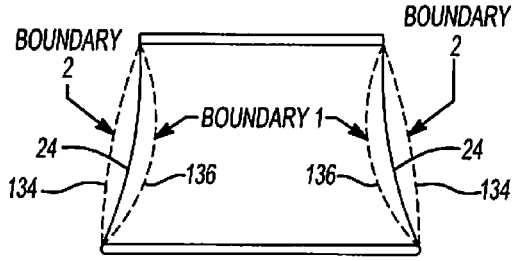
FIG. 36 is a side view depicting container boundaries of a shoulder portion of FIG. 29.
Figure 37:
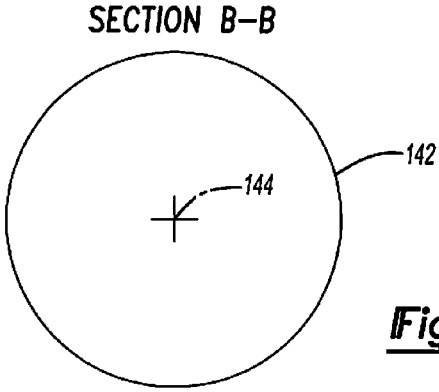
FIG. 37 is a cross-sectional view of section B-B of FIG. 29.
Figure 38:
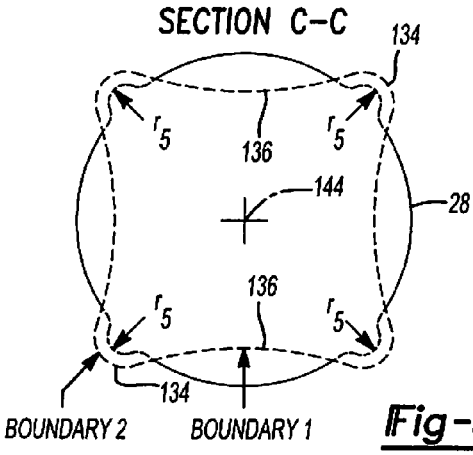
FIG. 38 is a cross-sectional view of section C-C of FIG. 29.
Figure 39:
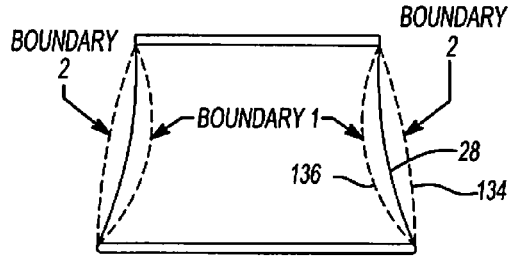
FIG. 39 is a side view depicting container boundaries of a sidewall portion of FIG. 29.

Turning now to FIGS. 29 and 35-39, another embodiment of the container 140 of FIG. 29 will be explained. Because FIG. 37 depicts a rigid label panel 142 as depicted and explained above using section B-B of FIG. 29, and FIG. 32, another detailed explanation will not be provided here. Similarly, because FIGS. 35 and 36 present a similar structure to FIGS. 38 and 39, only a description of FIGS. 35 and 36 will be presented here.

Continuing, FIG. 35 presents the cross-sectional structure of section A-A of FIG. 29. As depicted in FIG. 35, an as-molded container sidewall area 24 is depicted with a solid line while a deformed, after cooling wall structure is depicted with a dashed line. Radii $r_5$ denote a specific radius that may be molded into the container 140 before it is hot-filled. That is, the container 140 is molded with a radius $r_5$ to program the container 140 to deform or move in a particular direction. Radii $r_5$ causes or programs the container sidewall area 24 to begin and continue bulging or protruding in the direction of the original bulge, away from the central vertical axis 144 of the container 140. The container at the location of the radii $r_5$ may be thought of as a vertical column 134 within the sidewall area 24. That is, as the vacuum within the container 140 increases, the column 134 and radius $r_5$ resists deformation toward the central vertical axis 144 and at the same time, the concave wall 136 between the columns 134, begins to move inward, in a concave fashion, toward the central vertical axis 144. Thus, the column 134 may be viewed as a structural wall area that is better able to resist the inward drawing forces resulting from the internal vacuum pressure. The resulting transformation from the as-molded circular shape of sidewall area 24 with radii $r_5$ to the resulting protruding columns 134 and concave walls 136 is not only aesthetically pleasing, but functional in its response to the internal vacuum pressure by filling the internal container volume. FIG. 36 is a side view of the container 140 depicting the deformable sidewall area 24. More specifically, the sidewall area 24 depicts the as-molded location of the sidewall area 24 of the container 140, while the wall 136 represents the concave inward portion of the sidewall area 24 and the column 134 represents the column or corners of the sidewall area 24 when the sidewall area 24 is subject to an internal vacuum pressure. The wall 136 is noted with "Boundary 1" while the column 134 is noted with "Boundary 2", both of which denote the container wall boundaries of the as-molded and after-cooled container 140.

What is claimed is:

1. A hot-fill container with an internal volume, the container having a central, vertical axis, the container having an initial state and a vacuum state, the internal volume being subject to a vacuum pressure when in the vacuum state, the container comprising:

a threaded finish portion;

a shoulder portion located adjacent to the finish portion;

a bottom portion to support the container;

a plurality of collapsible body portions that deform when the container changes between the initial state and the vacuum state, one of the collapsible body portions having a cross section taken perpendicular to the central vertical axis, the cross section curving both inward concavely toward the central vertical axis and outward convexly away from the central vertical axis when in the vacuum state;

a plurality of grooves disposed between the shoulder portion and the bottom portion to provide circumferential strength to the plurality of collapsible body portions; and a smooth-surface, cylindrical rigid label panel located immediately between a pair of the grooves and a pair of the collapsible body portions, and only one groove is located between each of the collapsible body portions.

2. The hot-fill container of claim 1, wherein the collapsible body portions are generally circular when in the initial state, the container further comprising:

a plurality of protrusions with radii formed into each of the generally circular collapsible body portions, the cross section curving convexly along at least one of the plurality of protrusions when in the initial state and when in the vacuum state, the protrusions operable to hasten movement of the collapsible body portions away from a container central vertical axis at locations of the protrusions upon subjection of the internal volume to the vacuum pressure, and to hasten movement of the collapsible body portions toward the container central vertical axis at locations between the protrusions upon subjection of the internal volume to the vacuum pressure.

3. The hot-fill container of claim 2, wherein only one groove is located between each of the collapsible body portions and the groove is perpendicular to the central vertical axis.

4. A hot-fill container with an internal volume and a longitudinal axis, the container comprising:

a shoulder portion;

a body portion located adjacent to the shoulder portion;

a bottom portion for resting upon a flat surface and supporting the body portion and the shoulder portion; and a collapsible portion in the body portion, wherein:

the collapsible portion is located between the shoulder portion and the bottom portion, the collapsible portion having a thinner wall thickness at a vertical midpoint than at other points of the collapsible portion, and the collapsible portion is a bag-like structure.

5. The hot-fill container of claim 4, wherein the collapsible portion is generally circular in a cross-section taken perpendicular to the longitudinal axis before being subjected to the internal vacuum pressure, and wherein the cross section of the collapsible portion curves both inward concavely toward the longitudinal axis and outward convexly away from the longitudinal axis when subjected to the internal vacuum pressure.

6. The hot-fill container of claim 4, further comprising:

a plurality of strengthening ribs in the body portion that are located immediately adjacent to the bottom portion of the container.

7. The hot-fill container of claim 4, wherein the collapsible portion has a cross section taken perpendicular to the longitudinal axis, the collapsible portion further comprising:

a plurality of molded-in protrusions to hasten movement in the collapsible portion upon subjecting the internal volume of the container to the vacuum pressure, the cross section curving along at least one of the protrusions convexly away from the longitudinal axis before being subjected to the internal vacuum pressure, the cross section curving along at least one of the protrusions convexly away from the longitudinal axis when subjected to the internal vacuum pressure.

8. The hot-fill container of claim 7, wherein the collapsible portion has concave inward portions between the protrusions, the concave inward portions curving concavely inward toward the longitudinal axis of the container when subjected to the internal vacuum pressure.

9. The hot-fill container of claim 8, further comprising:

a vertical column between each concave inward portion, a radius of each vertical column from the longitudinal axis being different in length than a radius of each concave inward portion.

10. The hot-fill container of claim 4, further comprising:

a plurality of vacuum panels in the body portion.

11. The hot-fill container of claim 10, wherein the plurality of vacuum panels lie between the collapsible portion and the bottom portion.

12. The hot-fill container of claim 11, wherein the vacuum panels and the collapsible portion move toward a central vertical axis when the internal volume is subjected to an internal vacuum pressure.

13. The hot-fill container of claim 12, wherein a single strengthening groove lies between the collapsible portion and the plurality of vacuum panels to provide strength to the container.

14. The hot-fill container of claim 12, wherein the vacuum panels displace at least 45 cc of container volume and the collapsible body portion displaces at least 30 cc of container volume when the container is subjected to an internal vacuum.

15. The hot-fill container of claim 14, wherein a wall thickness of the collapsible body portion is less than .020 inches.

* * * * *